United States Patent [19]

Morrow

[11] 4,127,990

[45] Dec. 5, 1978

[54] DRAINAGE STRUCTURE FORMING METHOD

[76] Inventor: Otis L. Morrow, 727 Eastlake, Houston, Tex. 77034

[21] Appl. No.: 761,002

[22] Filed: Jan. 21, 1977

[51] Int. Cl.[2] ..... E02D 29/12

[52] U.S. Cl. ..... 405/36; 52/20; 264/32; 264/33; 264/34; 264/35

[58] Field of Search ..... 52/20; 61/10, 11, 40, 61/41, 42; 264/31, 32, 33, 34, 35

[56] References Cited

U.S. PATENT DOCUMENTS

| | | | |
|---|---|---|---|
| 992,782 | 5/1911 | Lambie | 264/32 |
| 1,712,510 | 5/1929 | Monie | 52/20 X |
| 3,621,623 | 11/1971 | Downes | 52/20 |
| 3,745,738 | 7/1973 | Singer | 52/20 X |
| 4,009,545 | 3/1977 | Rossborough | 52/20 X |
| 4,031,708 | 6/1977 | Hanson | 264/32 X |

*Primary Examiner*—Paul R. Gilliam
*Assistant Examiner*—David H. Corbin
*Attorney, Agent, or Firm*—Pravel, Wilson & Gambrell

[57] ABSTRACT

A new and improved method for forming a drainage structure, such as a manhole for a subterranean sewer pipe. In a first embodiment, a removable outer form is positioned in an excavation in the earth extending to the sewer pipe so that the earth surrounding the sewer may be undercut and removed through the removable outer form. Concrete is poured into the undercut area surrounding the sewer pipe to a height adjacent the lower edge of the outer form and a second cylindrical inner form is positioned within the outer form so that concrete may be poured into the space between the forms to form upwardly extending wall portions to the surface. In a second embodiment, the outer form is positioned in an excavation at a predetermined location and a concrete base portion is formed. The inner form is positioned in the outer form and predetermined quantities of sand are poured into the space between the forms for facilitating connection with sewer pipes. In both embodiments, the outer form is raised and vibrated periodically during the pouring of sections of the wall portions and the inner and outer forms are removed after the wall portions have been poured to the predetermined height with a grate support means formed at the uppermost wall portion.

24 Claims, 6 Drawing Figures

4
4

DRAINAGE STRUCTURE FORMING METHOD

CROSS-REFERENCE TO RELATED APPLICATIONS

This application relates to drainage structure forming methods, as does co-pending U.S. Pat. application Ser. No. 712,015, filed Aug. 5, 1976, of which Applicant is inventor.

BACKGROUND OF THE INVENTION

This invention relates generally to the field of drainage structures, such as manholes for underground sewer pipes.

As far as known, the usual prior method of forming drainage structures, such as manholes for subterranean sewer pipes, has consisted of making an excavation in the earth extending downwardly to the sewer pipe and building or setting up forms which may be prefabricated in sections and which are positioned in the excavation, and thereafter pouring concrete in the forms to form the manhole. The excavation is generally made sufficiently large to allow a workman to enter a work space between the excavation walls and the forms for setting up the forms. Many satisfactory manholes have been foamed with this prior art method though the method involves a tedious and time-consuming job to set up the forms in the excavation. As with most excavations several feet below the ground surface, if heavy or extensive rains occur after the excavation and before or after building the forms, caving in of the dirt forming the walls of the excavation may occur and require extensive excavating and/or repairs which are very costly and wasteful. The time heretofore required for excavating and setting up stationary forms makes it difficult to complete the excavation and manhole in a single day or in a short enough period to avoid such problems caused by rainfall.

SUMMARY OF THE INVENTION

This invention relates to a new and improved method for forming drainage structures, such as manholes for a subterranean sewer pipe. In a first embodiment, the method steps include making a first excavation in the earth extending downwardly to the sewer pipe and inserting a tightly fitting cylindrical form means through the excavation to the sewer pipe and undercutting the sewer pipe by excavating the earth surrounding the sewer pipe. Concrete is poured in the undercut portion surrounding the sewer pipe to the uppermost wall portion of the sewer pipe. A collapsible cylindrical inner form means is then positioned within the outer form means and sequential steps of pouring concrete in the space between the inner and outer form means is begun. After pouring a portion of the upwardly extending wall means, the outer form means is partially raised while being vibrated to allow the concrete to settle against the walls of the excavation. A second wall portion is likewise poured between the inner and outer form means and the steps of raising and vibrating the outer forms are repeated and these steps are again repeated as necessary to form the wall portions of the desired height. A grate support means of concrete is formed at the uppermost wall portion of the manhole. A section of the sewer pipe is removed within the area of the wall portion of the sewer pipe to allow sewage to flow into the pipe. The uppermost portion of the concrete surrounding the sewer pipe may be sloped inwardly before hardening to facilitate flow of sewage into the sewer pipe.

In a second embodiment, the first cylindrical form means is positioned in an excavation to a predetermined depth and a concrete base portion is poured in the first form. The second cylindrical form means is postioned on the base portion and predetermined quantites of sand are poured into the space between the forms at predetermined locations for facilitating subsequent connection with a sewer pipe. The sequential steps for forming the wall portions are then performed. A section of the wall portion is removed at the predetermined locations of the sand for connecting with a sewer pipe.

DESCRIPTION OF THE PREFERRED EMBODIMENT

Figures 1, 2, 3:
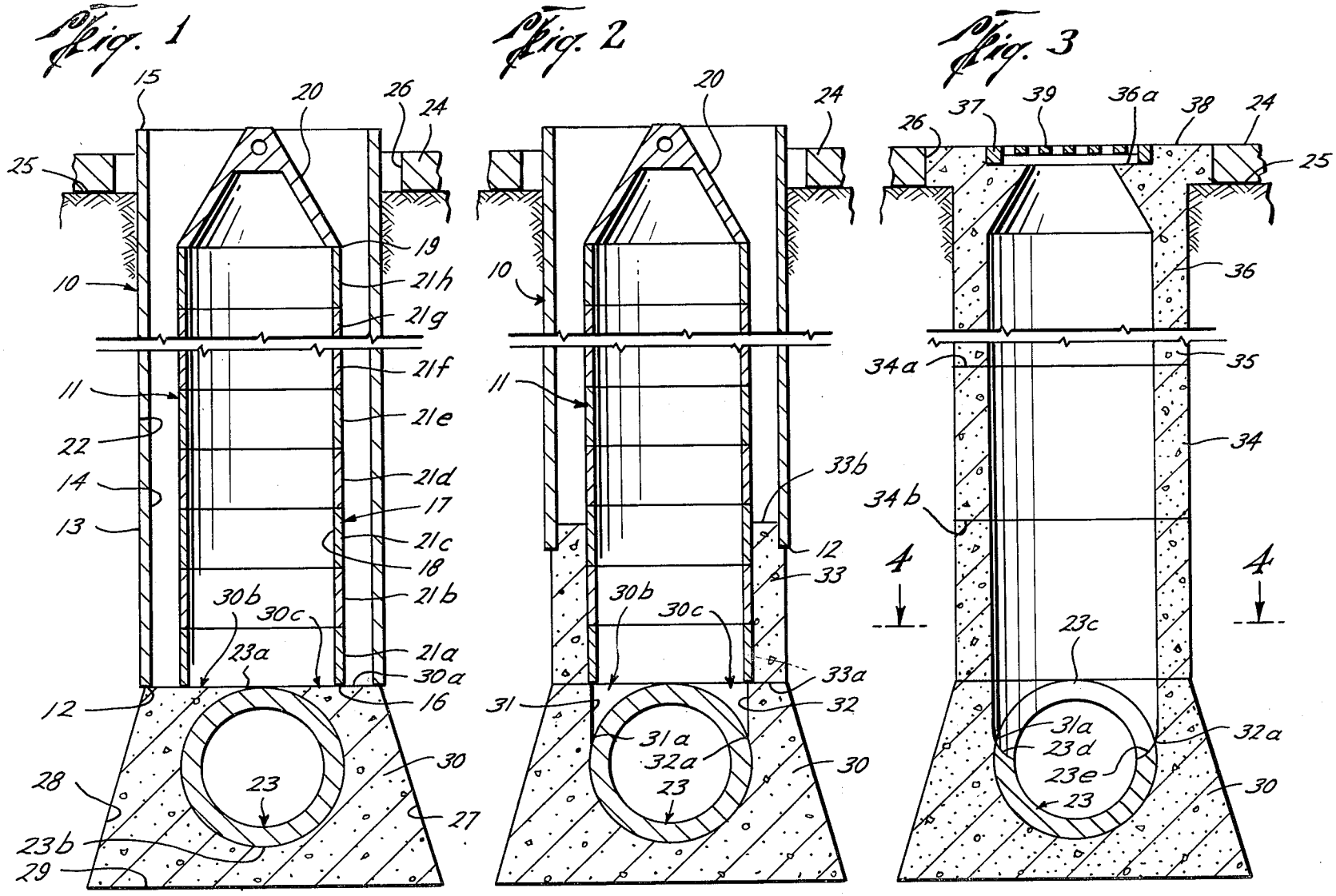
FIG. 1 is a cross-sectional side elevation showing the inner and outer form means in position after the concrete is poured surrounding the sewer pipe.
FIG. 2 is a cross-sectional side elevation showing the outer form means raised after a first section of the wall portion is formed.
FIG. 3 is a cross-sectional side elevation of a completed manhole.

A manhole in various steps of completion constructed by the method steps of the new and improved method for forming a drainage structure of this invention is shown in FIGS. 1–3. The form means for practicing the method of this invention includes an outer form 10 and an inner form 11. The outer form 10 is preferably a large diameter cylindrical steel pipe which includes a lower edge 12, outer surface 13, inner surface 14 and an upper edge 15. The inner form 11 includes a lower edge 16, outer surface 17, inner surface 18 and an upper edge 9. The inner form further includes a top 20 having the shape of a truncated cone and which fits upon the upper edge 19 of the inner form. The inner form 11 is composed of identical sections designated **21*a*, 21*b*, 21*c*, 21*d*, 21*e*, 21*f*, 21*g* and 21*h***. The top and each section of the inner form are formed of several components which may be assembled for use. They may be disassembled for removal after the manhole has been removed. Suitable prefabricated inner forms are known in the art and various types may be used to practice the method of this invention.

Prior to the positioning of the inner and outer forms, it is necessary to first form an excavation in the earth as defined by the surface 22 which in the case of this invention is cylindrical in form. This excavation may be typically formed using a large diameter auger of the type which is used to form excavations for pilings. It is understood that the embodiment as shown in FIGS. 1–3 involves the forming of a manhole to connect with a subterranean pipe 23, usually a sewer or drainage pipe, which is already in position in the earth. As shown in FIG. 1, a surface covering or pavement 24 has been previously formed on the earth surface 25 which required the removal of a section of the pavement as defined by inner wall surface 26. The excavation defined by cylindrical wall surface 22 is formed downwardly to the uppermost outer wall surface 23a of the sewer pipe 23. The outside diameter of the outer form 10 is preferably substantially the same as the inner diameter of the excavation defined by cylindrical surface 22, so that a downward force is usually applied to the outer form 10 to position it as shown in FIG. 1. At the same time that the downward force is applied to the outer form, it is preferable to also rotate the outer form which facilitates its downward movement due to the relatively tight fit with the excavation walls. Downward and rotating forces may be applied by connecting the upper end of the outer form with the screw of an auger or similar rotating device, such as the auger used to form the excavation.

After positioning the outer form 10 in the excavation so that the lower edge 12 of the outer form 10 contacts or almost contacts the uppermost outer wall surface 23a of the sewer pipe 23, the earth surrounding the sewer pipe 23 is removed or undercut to form a second excavation defined by the side walls 27 and 28 and bottom wall 20. Although shown as having relatively straight side wall portions with sharp corners, it is understood that in actual practice the walls of the second excavation would not be as sharply defined as in the drawings. The bottom wall 29 of the second excavation is below the lowermost outer wall surface 23b of the sewer pipe so that undercutting excavation is completely around the sewer pipe. The undercutting step may be performed manually with a shovel or any other suitable apparatus. After performing the second undercutting excavation, concrete is poured in the undercut portion to form a bottom portion 30 of the manhole. The bottom portion 30 having lower base portion 30d completely surrounds the sewer pipe 23 and the upper surface 30a of the bottom portion 30 is at substantially the same level as the lower edge 12 of the outer form and the uppermost outer wall surface 23a of the sewer pipe. Sections 30b and 30c at the upper part of the bottom portion are preferably removed prior to hardening of the concrete forming the bottom portion 30 to form sloped side walls 31 and 32 for a purpose as explained hereinafter.

After pouring the bottom portion 30, the inner form 11 is positioned as shown in FIG. 1 by assembling a plurality of annular wall sections, such as wall section 21a, and by positioning the top 20 thereon. The top 20 prevents concrete from getting inside the inner form during the pouring of the upwardly extending walls of the manhole. With the inner and outer forms in position as shown in FIG. 1, the first or lowermost cylindrical wall portion 33 (FIG. 2) is poured in the space between the inner and outer forms. The lower edge 33a of the first cylindrical wall portion 33 rests upon, or becomes integral with, the upper surface 30a of the bottom portion 30. The lower wall portion 33 is typically poured to a height of in the order of four feet as defined by the upper edge 33b of the wall portion. After pouring the concrete to form the wall portion 33 and before the concrete has had time to set, the outer form 10 is raised as shown in FIG. 2 with the lower edge 12 of the outer form maintained below the upper edge 33b of the wall portion 33. During the raising of the outer form, a vibration force may be applied in any known manner to the outer form to facilitate the settling of the unset concrete forming the wall portion 33 against the cylindrical surface 22 defining the first excavation. This is more clearly shown in FIG. 2 of the drawings.

After raising the outer form 10 to the position shown in FIG. 2, a second cylindrical wall portion 34 is formed by pouring concrete in the space between the inner and outer forms to a height approximately as shown in FIG. 3 defined by the upper edge 34a and lower edge 34b of the second wall portion. After pouring the second cylindrical wall portion 34 to a height which is typically four feet, the outer form 10 is again raised while vibrating it to allow the concrete forming the second cylindrical wall portion to settle against the earthen cylindrical surface 22 defining the first excavation. It is understood that the steps of forming the cylindrical wall portions can be repeated as necessary depending on the depth from the earth surface to the sewer pipe which is being connected with the manhole. As shown in FIG. 3, this may comprise a third cylindrical wall portion 35 and an uppermost cylindrical wall portion 36.

The uppermost cylindrical wall portion 36 is poured to a height as defined by the upper surface 36a as shown in FIG. 3. The grate support structure is then positioned upon the upper surface 36a as shown in FIG. 3 and the pouring of the concrete is resumed until the uppermost cylindrical wall portion 36 extends to a height as defined by the surface 38 which corresponds to the upper surface 24a of the pavement 24. It is there that the outer form means may be completely removed when the uppermost cylindrical wall portion 36 is poured to a height corresponding to the earth surface 25. The wall sections and top of the collapsible inner form means are collapsed and removed after the concrete of the wall portions has set sufficiently to be self-sustaining.

Figure 4:
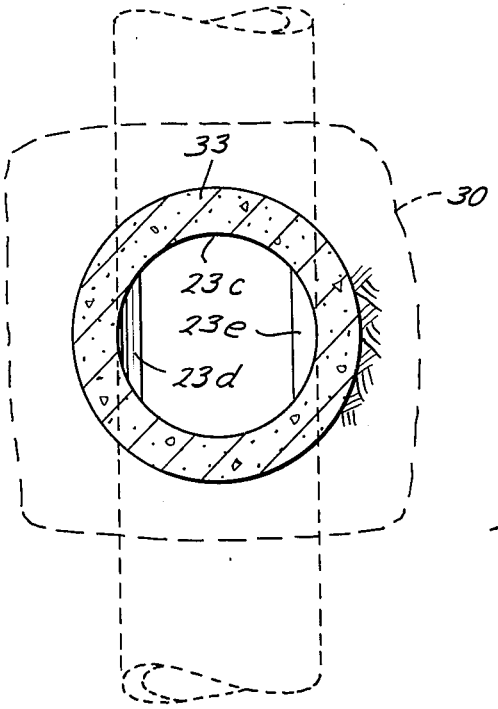
FIG. 4 is a cross-section taken along line 4—4 in FIG. 3.

After removal of the inner form means, a workman can enter the manhole defined by the wall portions for removal of an upper section of the sewer pipe 23 to form an opening therein defined by the sewer pipe wall surface 23c as shown in FIG. 4. This section of the sewer pipe may be removed by chipping away the concrete forming the sewer pipe in the case of concrete sewer pipes to a point of each side of the sewer pipe corresponding to the surface portions 23d and 23e which extend to the lowermost edges 31a and 32a of the sloped sidewalls 31 and 32 performed before the concrete of the bottom portion 30 had fully hardened. This provides an opening connecting the sewer pipe with the upwardly extending wall portions without any obstructions which would hinder the flow of sewage into the sewer pipe. As shown in FIG. 4, the opening in the sewer pipe corresponds substantially in size to the inner wall surfaces of the upwardly extending wall portions. After forming the opening in the sewer pipe, a grate 39 may be positioned in the grate support structure 37 to complete the manhole.

Figure 5:
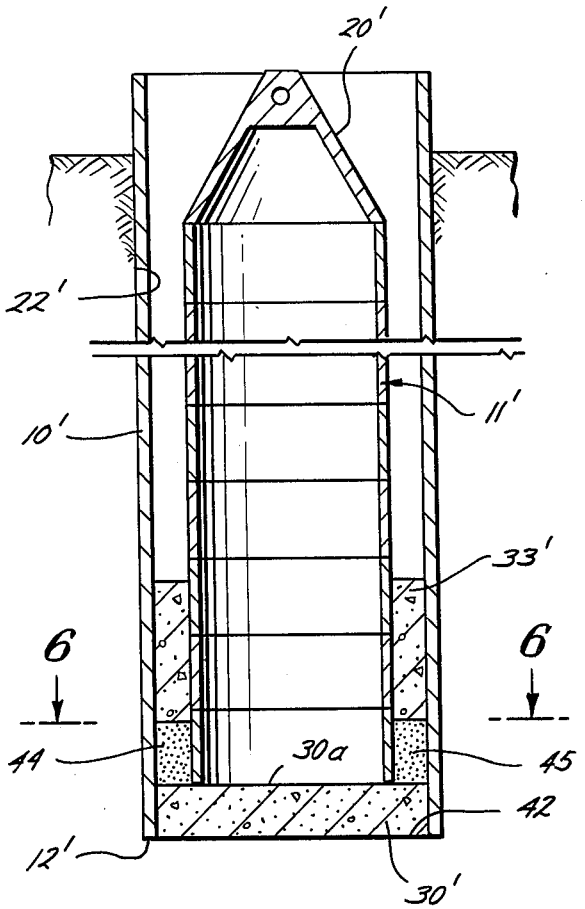
FIG. 5 is a cross-sectional side elevation of a second embodiment showing the inner and outer form means in position.
Figure 6:
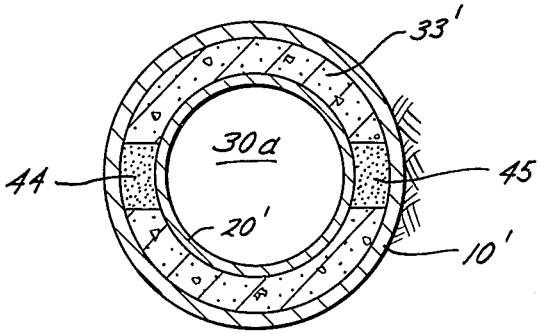
FIG. 6 is a cross-section taken along line 6—6 in FIG. 5.

An alternative form of the method of this invention is shown in FIGS. 5 and 6. This alternative method is used when the manhole is formed at a preselected location prior to the laying of sewer pipe. Typically, the area where the sewer pipe is to be laid and the manhole is to be positioned is staked out indicating their locations. Similar components to those shown in the embodiment in FIGS. 1–4 have corresponding numerals with the addition of the prime superscript. In this case, excavation is formed in the earth extending downwardly from the earth surface 40 and defined by the inner surface 22' of the earthen walls of the excavation. As with the embodiment shown in FIGS. 1–4, the excavation is typically made with a large auger, such as the type used in boring holes for pilings. After performing the excavation, outer form 10' is positioned in the excavation in the same manner as is the form 10 described above. The lower edge 12' of the outer form 10' may be positioned adjacent the bottom surface 42 of the excavation. Alternatively the other form may be positioned with its bottom surface spaced from the bottom surface. The other may be raised shortly after pouring the base or bottom portion 30' to allow the concrete to settle against the wall of the first excavation 22. A vibrating force may be applied during this raising step.

The next step includes pouring a concrete base or bottom portion 30' up to a height defined by the upper surface 30a' of the bottom portion 30a. An inner form 11' identical to the inner form 11 described above, is then positioned with the lower edge 16' of the inner form at the same height as the upper surface 30a of the bottom portion 30'. After so positioning the inner form 11', as many small quantities of sand 44 and 45 as there will be sewer pipe connections are poured in the space between the inner and outer forms as shown in FIGS. 5 and 6. The location for pouring these quantities of sand is selected by the location of a sewer pipe which is to be connected to the manhole. A next step includes pouring concrete in the space between the inner and outer forms to cover the quantities of sand and form a first cylindrical wall portion 33' as was done to form the cylindrical wall portion 33 as described above. The steps in forming the remainder of the manhole are identical to those in forming the cylindrical wall portions 34, 35 and upper cylindrical wall portion 36 as described above. This includes positioning a grate support means, such as grate support means 37.

After forming the upper portion of a completed manhole, such as shown in FIG. 3 above, the inner form 11' is collapsed and removed. A workman may then enter the cylindrical manhole and chisel away a portion of the cylindrical wall portion 33' to form an opening for positioning a sewer pipe. After removal of the inner form, the quantity of sand either falls away or may be easily removed leaving a small opening in the wall portion 33'. This small opening provides a starting point to facilitate the formation of larger openings in the manhole for connecting the manhole with a sewer pipe which is to be laid thereafter. Other suitable means could be substituted for the quantities of sand to provide a starting point for forming an opening for connecting with a sewer pipe.

The method steps as described above and as shown in FIGS. 1–6 allow completion of a concrete manhole in a short period which typically may be no more than one day which virtually eliminates the chances of rainfall interfering with the work. Using the techniques described above, it is possible to begin the work on the manhole in the morning and complete the work by the afternoon. In the event that rainfall does occur, once the first cylindrical wall portions 33 or 33' are formed as shown in FIGS. 2 and 5, respectively, the occurrence of rain will not destroy all of the previous work done. For instance, it is possible to cover the top of the outer form with a waterproof sheet. The earthen walls of the excavation cannot cave in since the walls of the outer form means fit tightly against them.

The foregoing disclosure and description of the invention are illustrative and explanatory thereof, and various changes in the size, shape and materials as well as in the details of the illustrated construction may be made without departing from the spirit of the invention.

I claim:

1. A method for forming a drainage structure, such as a manhole having a bottom portion and an upwardly extending wall portion for communication with a subterranean sewer pipe, comprising the steps of:

forming a first excavation in the earth from the surface to a subterranean sewer pipe;

positioning a removable outer form means in the excavation extending from the surface to the uppermost wall portion of the sewer pipe and fitting tightly with wall portions of the first excavation to prevent caving in thereof;

undercutting the sewer pipe by forming a second excavation in the soil surrounding the sewer pipe to a depth below the lowermost wall portion of the sewer pipe;

pouring concrete into the excavation surrounding the sewer pipe to a level adjacent the uppermost wall portion of the sewer pipe to form the bottom portion;

positioning a removable inner form means within the outer form means extending upwardly from the uppermost wall portion of the sewer pipe; and pouring concrete in the space between the outer and inner form means for forming the upwardly extending wall portion to a predetermined height.

2. The method as set forth in claim 1, wherein:

the step of forming the excavation from the surface to the sewer pipe includes drilling a cylindrical hole with an auger from the earth surface to a sewer pipe.

3. The method as set forth in claim 1, wherein:

the step of forming the first excavation includes removing sufficient earth to provide an excavation cross-section substantially the same as the outer form means to provide a relatively tight fit therebetween.

4. The method as set forth in claim 1, including the step of:

forming an opening in the sewer pipe in communication with the upwardly extending wall portion.

5. The method as set forth in claim 1, including the step of:

sloping the uppermost surface of the concrete bottom portion downwardly from the outer form means toward the longitudinal axis of the sewer pipe for runoff of sewage.

6. The method as set forth in claim 5, wherein:

the step of sloping includes removing some of the concrete of the bottom portion before it is fully hardened.

7. The method as set forth in claim 5, wherein:

the step of sloping includes sloping the uppermost surface to a level below the uppermost wall portion of the sewer pipe.

8. The method as set forth in claim 1, including the step of:

forming a grate support means at the uppermost wall portion.

9. The method as set forth in claim 1, wherein:

the step of positioning the outer form means includes positioning a cylindrical casing in the earth extending from the surface to the sewer pipe.

10. The method as set forth in claim 1, wherein:

the step of forming the upwardly extending wall portion includes pouring concrete in the space between the outer and inner forms to at least a first predetermined height;

raising the outer form to at least a second predetermined height with the lower edge of the outer form means below the first predetermined height to form a first wall section; and pouring concrete in the space between the outer and inner form means for forming at least a second wall portion extending upwardly from the first wall section.

11. The method as set forth in claim 10, wherein:

the step of raising the outer form means is performed before the concrete of the wall portion has hardened to allow the concrete to settle against the wall surface of the first excavation.

12. The method as set forth in claim 11, including the step of:

vibrating the outer form means during raising to firm the soil walls of the first excavation.

13. The method as set forth in claim 3, wherein:

the step of positioning the outer form means includes pushing the outer form means into the first excavation.

14. The method as set forth in claim 13, including the step of:

rotating the outer form means while pushing to facilitate positioning the first form means tightly fitting against the walls of the excavation.

15. The method as set forth in claim 4, wherein:

the step of forming the opening includes removing a section of the wall portion of the sewer pipe.

16. A method for forming a drainage structure, such as a manhole having a bottom portion and an upwardly extending wall portion for communication with a subterranean sewer pipe, comprising the steps of:

forming a first excavation in the earth to a predetermined depth below the sewer pipe;

positioning a removable outer form means in the excavation extending from the earth surface to the predetermined depth and having substantially the same outer dimension as the first excavation to prevent caving in thereof;

forming a base portion by pouring concrete through the outer form means to a first level adjacent an uppermost wall surface of the sewer pipe;

thereafter positioning a removable inner form means within the outer form means having a smaller outer dimension than the inner dimension of the outer form means to provide a longitudinally extending lateral space therebetween, and extending downwardly to the first level; and pouring concrete in the space between the inner and outer form means for forming the upwardly extending wall portion to a predetermined height.

17. The method as set forth in claim 16, including the step of:

pouring at least one small quantity of sand into the space between the outer and inner form means at selected locations to facilitate forming an opening in the wall portion for connecting with at least one sewer pipe.

18. The method as set forth in claim 16, including the step of:

forming a grate support means at the uppermost section of the wall portion.

19. The method as set forth in claim 16, wherein:

the step of positioning the outer form means includes positioning a cylindrical casing in the earth extending from the surface to the predetermined depth by rotating the casing while applying a downward force thereto.

20. The method as set forth in claim 16, wherein:

the step of forming the upwardly extending wall portion includes pouring concrete in the space between the outer and inner forms to at least a first predetermined height;

raising the outer form to at least a second predetermined height with the lower edge of the outer form means below the first predetermined height to form a first wall section; and pouring concrete in the space between the outer and inner form means for forming at least a second wall portion extending upwardly from the first wall section.

21. The method as set forth in claim 20, wherein:

the step of raising the outer form means is performed before the concrete of the wall portion has hardened to allow the concrete to settle against the wall surface of the first excavation.

22. The method as set forth in claim 21, including the step of:

vibrating the outer form means during raising to firm the soil walls of the first excavation.

23. The method as set forth in claim 16, including the step of:

forming at least one opening in the wall portion for connecting with at least one sewer pipe.

24. The method as set forth in claim 16, wherein:

the step of forming the first excavation includes forming a cylindrical hole in the earth.

* * * * *